US007180057B1

(12) United States Patent
Senko et al.

(10) Patent No.: US 7,180,057 B1
(45) Date of Patent: Feb. 20, 2007

(54) TWO-DIMENSIONAL QUADRUPOLE ION TRAP

(75) Inventors: Michael W. Senko, Sunnyvale, CA (US); Jae C. Schwartz, San Jose, CA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 11/197,083

(22) Filed: Aug. 4, 2005

(51) Int. Cl.
*H01J 49/42* (2006.01)

(52) U.S. Cl. ..... 250/282; 250/292; 250/291; 250/283

(58) Field of Classification Search ..... None
See application file for complete search history.

(56) References Cited

U.S. PATENT DOCUMENTS 5,420,425 A 5/1995 Bier et al.
6,087,658 A 7/2000 Kawato
6,797,950 B2 9/2004 Schwartz et al.
6,911,651 B2 6/2005 Senko et al.
2004/0051036 A1* 3/2004 Franzen et al. ..... 250/282
2004/0245460 A1* 12/2004 Tehlirian et al. ..... 250/292
2005/0017170 A1 1/2005 Schwartz et al.

* cited by examiner

*Primary Examiner*—Nikita Wells
(74) *Attorney, Agent, or Firm*—Sharon Upham

(57) ABSTRACT

An aperture design for a linear ion trap is provided in which the aperture is optimized to minimize possible axial field inhomogeneities whilst preserving the structural integrity of the quadrupole rods. In general, the invention provides a linear ion trap for trapping and subsequently ejecting ions. The linear ion trap comprises a plurality of rods which define an interior trapping volume which has an axis extending longitudinally. One or more of the rods includes an aperture which extends both radially through the rod and longitudinally along the rod. The aperture being configured such that the ions can pass from the interior trapping volume through the aperture to a region outside the interior trapping volume. At least one recess is disposed adjacent the aperture, extending longitudinally along the rod and facing the interior trapping volume, the recess not extending radially through the rod.

13 Claims, 4 Drawing Sheets

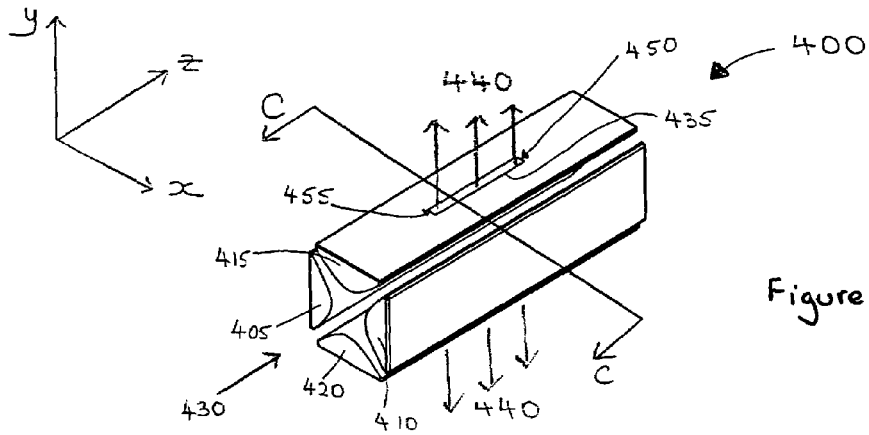
Figure 4A
Figure 4B
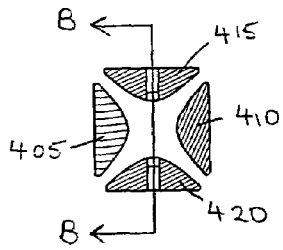
SECTION C-C
Figure 4C
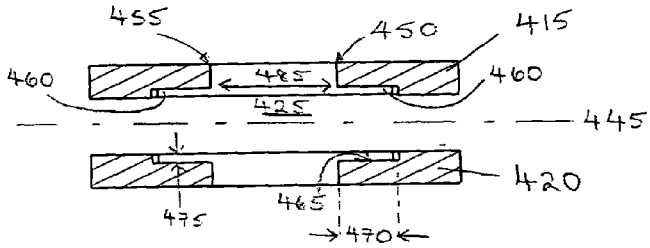
SECTION B-B
Figure 4D
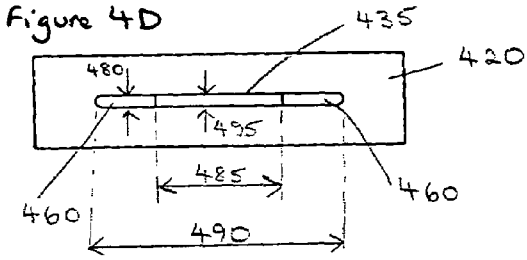

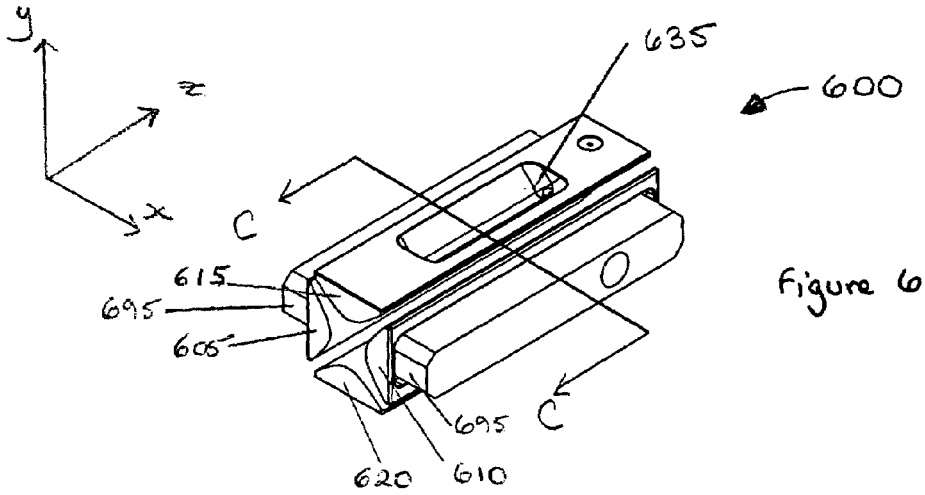
Figure 6A
Figure 6B
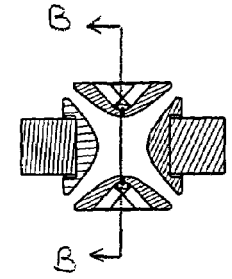
SECTION C-C
Figure 6C
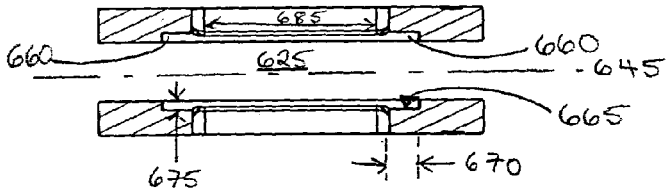
SECTION B-B
Figure 6D
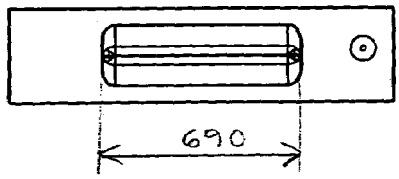

TWO-DIMENSIONAL QUADRUPOLE ION TRAP

FIELD OF THE INVENTION

The disclosed embodiments of the present invention relate generally to a two-dimensional ion trap.

BACKGROUND OF THE INVENTION

Quadrupole ion traps are devices in which ions are introduced into or formed and contained within a trapping volume formed by a plurality of electrode or rod structures by means of substantially quadrupolar electrostatic potentials generated by applying RF voltages, DC voltages or a combination thereof to the rods. To form a substantially quadrupole potential, the rod shapes are typically hyperbolic.

A two-dimensional or linear ion trap typically includes two pairs of electrodes or rods, which contain ions by utilizing an RF quadrupole trapping potential in two dimensions, while a non-quadrupole DC trapping field is used in the third dimension. Simple plate lenses at the ends of a quadrupolar structure can provide the DC trapping field.

When using a mass selective instability scan in a linear ion trap, the ions are most efficiently ejected from the trap in a radial direction. Some researchers have ejected ions between two of the quadrupole rods. However, due to high field gradients loss of ions is substantial. To increase the efficiency ions are ejected through a rod by introducing an aperture in the rod. For the linear ion trap, one manner in which an aperture can be introduced is along the length of the rod. When an aperture (or apertures) is cut into one or more of the linear ion trap electrodes to allow ions to be ejected from the device, the electric potentials are degraded from the theoretical quadrupole potential and therefore the presence of this aperture can impact several important performance factors. Consequently, the characteristics of this aperture are significant.

The introduction of an aperture into a linear ion trap not only may degrade the theoretical quadrupole potential, but may also contribute to the degradation of the structural integrity of the rods themselves, thus leading to mechanical deviations in the axial direction and ultimately affecting the performance characteristics such as the resolution attainable by such an ion trap mass spectrometer.

The performance of such a two-dimensional ion trap is more susceptible to mechanical errors than a three-dimensional ion trap. In a three-dimensional ion trap, all of the ions occupy a spherical or ellipsoidal space at the center of the ion trap, typically an ion cloud of approximately 1 mm in diameter. The ions in a two-dimensional ion trap, however, are spread out along a substantial fraction of the entire length of the ion trap in the axial direction which can be several centimeters or more. Therefore, geometric imperfections, misalignment of the rods, or the mis-shaping of the rods can contribute substantially to the performance of the two-dimensional ion trap. For example, if the quadrupole rods are not parallel along the substantial length of the rods, then ions at different axial positions within the ion trap experience a slightly different field strength. This variation in field strength experienced will in turn cause the ejection time of the ions during mass analysis to be dependent on the axial position. The net result for an ion cloud of the same m/z is increased overall peak widths and degraded resolution.

In addition to mechanical errors causing axial field inhomogeneity, the fringe fields caused by the end of the electrodes as well as the ends of any slots cut into the rods can also cause significant deviation in the strength of the radial quadrupole field along the length of the device. Ideally to keep the electric fields uniform, the ejection aperture would extend along the entire length of the rod, but this presents numerous construction challenges. To avoid these, ejection slots are typically located only along some fraction of the central region (for example 60%) of the total ion trap length. This however, would lead to a variation in the radial quadrupolar potential near the ends of the slots in addition the effects at the ends of the rods. Ions which reside in these areas would would be ejected at different times than ions residing more in the center of the device and therefore would result in a reduction in mass resolution.

One approach to produce a homogenous electric field is shown in FIG. 1 which depicts a two-dimensional quadrupole structure 100 having hyperbolic rods 105, 110, 115 and 120, each rod 105, 110, 115, 120 cut into three axial sections, Front section (a), Center Section (b) and Back Section (c). These three sections, each with a discreet DC level, allow containment of the ions along the axis in the Center Section (b) of the ion trap. More details on this structure can be found in U.S. Pat. No. 5,420,425. The use of a linear ion trap in which the rods are segmented provides one way in which to minimize the axial variation of the electric fields towards the ends of the rods and therefore to minimize its affect on the performance. This architecture creates a radial trapping potential which is very homogenous in the region where the ions are contained within the central section of the trap.

In the two-dimensional linear ion trap configuration discussed in the U.S. Pat. No. 5,420,425 patent, 12 V applied to the front and beck sections creates an axial trapping potential which is able to confine the ions to the central 25 mm (+/−12.5 mm from center) of the quadrupole structure 100 (if the axial energies remain below 1 eV). The aperture 125 has a length of approximately 29 mm and so allows efficient ion ejection —while maintaining a high level of axial homogeneity of the radial quadrupolar potential in the region containing the entire ion cloud. This can be seen in FIG. 2, trace 205 which shows the axial potential as a function of axial position.

The voltages necessary to operate such a two-dimensional, three-sectioned quadrupole structure 100 equates to nine separate combinations of voltages applied to twelve electrodes (including the DC voltages applied to the separate sections of each road to produce an axial trapping field, the RF voltage applied to the rod pairs to produce the radial trapping field, and the AC voltage applied across one pair of rods for isolation, activation, and ejection of ions). This requires the construction of a considerably elaborate RF/AC/DC system.

A simpler design for a linear ion trap uses single rod sections 305 with axial trapping provided solely by DC voltages applied to the end lenses 310, as illustrated in FIG. 3. This reduces the number of discreet voltages from nine to three, significantly reducing the complexity of the electronics system. A significant disadvantage of this design is that the axial trapping fields do not penetrate well into the interior of the ion trap, allowing ions to travel further from the center of the trap. This can be seen in FIG. 2, trace 210, which illustrates that when 200 V is applied to the end lenses, ions with 1 eV of axial energy expand to cover approximately 40 mm (+/−20 mm from center). This allows the ions to experience more axial field inhomogeneities due to the fringe fields at the end of the rods and the finite length of the ejection aperture.

SUMMARY

The present invention provides an improved linear ion trap and mass spectrometer incorporating such an ion trap.

The invention provides an aperture design for use in a linear ion trap that is optimized to minimize possible axial field inhomogeneities whilst preserving the structural integrity of the quadrupole rods. In general, in one aspect, the invention provides a linear ion trap for trapping and subsequently ejecting ions. The linear ion trap comprises a plurality of rods which define an interior trapping volume which has an axis extending longitudinally. One or more of the rods includes an aperture which extends both radially through the rod and longitudinally along the rod. The aperture being configured such that the ions can pass from the interior trapping volume through the aperture to a region outside the interior trapping volume. At least one recess is disposed adjacent the aperture, extending longitudinally along the rod and facing the trapping region, the recess not extending radially through the rod.

Particular implementations can include one or more of the following features. The plurality of rods can include multipole rods shaped to provide a substantially quadrupolar potential in the interior trapping region. The recess can be directly coupled to the aperture and can include two recesses. The recess can have a depth extending radially into the rod, the depth being greater than a width of the recess. The recess can have a depth that is greater than three times the width of the recess. The aperture can open outwardly in a direction from the interior trapping volume to a region exterior to the interior trapping volume. The recess can open outwardly in a direction from within the rod towards the interior trapping volume. The aperture can be an elongated slot having two ends. The recess can extend longitudinally beyond one or both ends of such a slot. The at least one recess may include two recesses, one recess disposed at each end of the elongated slot. The elongated slot can have a width, and the width of the recess can be substantially the same as the width of the elongated slot.

The invention can be implemented to realize one or more of the following advantages. Utilization of an aperture with an electrode structure according to the invention can reduce the complexity of the electronics system required to operate a linear ion trap. Utilization of an aperture according to the invention can allow ions to experience less axial field inhomogeneities. The presence of an aperture according to the invention can reduce or minimize the distortion of the radial quadrupolar potential and enhance the axial field homogeneity. Utilization of an aperture according to the invention can minimize possible fringe effects whilst preserving the structural integrity of the quadrupole rods. As a consequence, performance of a mass spectrometer incorporating a linear ion trap according the invention can yield an improved resolution and mass accuracy. A single segmented ion trap according to this invention can provide mass resolution similar to an ion trap with a segmented rod architecture.

Other features and advantages of the invention will become apparent from the description, the drawings, and the claims.

BRIEF DESCRIPTION OF THE DRAWINGS

For a better understanding of the nature and objects of the invention, reference should be made to the following detailed description, taken in conjunction with the accompanying drawings, in which:

FIG. 4A is an isometric view of an aspect of the invention showing a single sectioned two-dimensional substantially quadrupolar ion trap.

FIG. 4B is a cross-sectional view of the aspect of the invention shown in FIG. 4A, along C—C.

FIG. 4C is a cross-sectional view of the aspect of the invention shown in FIG. 4B, along B—B.

FIG. 4D is a view taken of FIG. 4C, from within the interior trapping volume and looking out of the aperture.

FIG. 6A is an isometric view of an aspect of the invention showing a single sectioned two-dimensional substantially quadrupolar ion trap.

FIG. 6B is a cross-sectional view of the aspect of the invention shown in FIG. 6A, along C—C.

FIG. 6C is a cross-sectional view of the aspect of the invention shown in FIG. 6B, along B—B.

FIG. 6D is a view taken of FIG. 6C, from within the interior trapping volume and looking out of the aperture.

Like reference numerals refer to corresponding parts throughout the several views of the drawings.

DETAILED DESCRIPTION OF EMBODIMENTS

Figure 1:
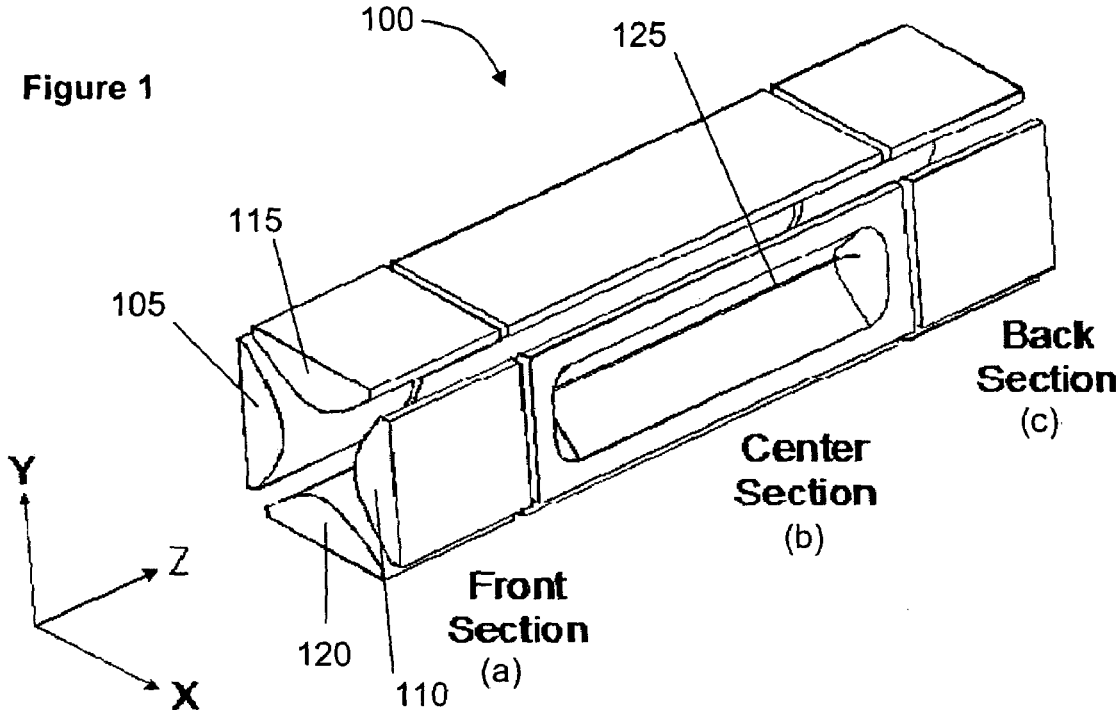
FIG. 1 is an isometric view of a segmented quadrupolar linear ion trap comprising a center section and two end sections.
Figure 2:
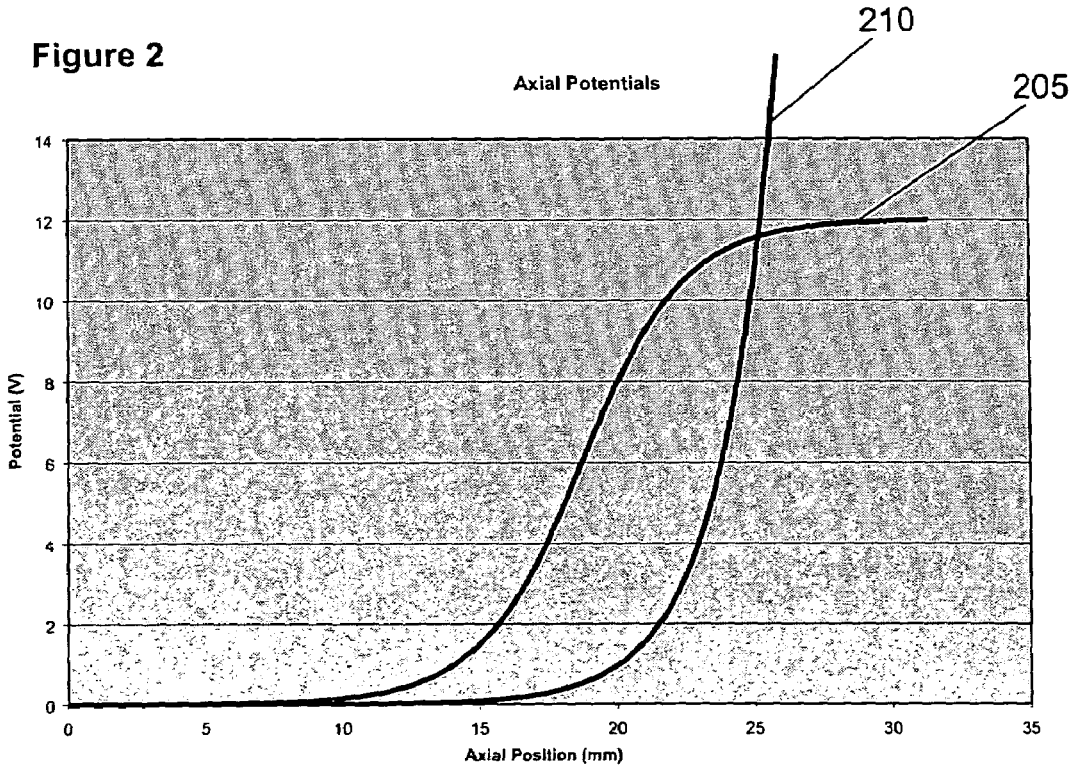
FIG. 2 is a graph showing axial trapping potential vs. axial position for various ion trap configurations.

One aspect of the present invention is illustrated in FIGS. 4A, 4B, 4C and 4D. A two-dimensional substantially quadrupole structure 400 is shown in FIG. 4A comprising a plurality of electrodes or rods, in this particular case, two pairs of opposing rods, a first pair 405, 410 and a second pair 415, 420. In this figure, as per convention, the rod pairs are aligned with the x and y axes and are therefore the first pair 405, 410 is denoted as the X rod pair, and the second pair 415, 420 is denoted as the Y rod pair. The rods 405, 410, 415, 420 have a hyperbolic profile to substantially match the equipotential contours of the quadrupolar RF potentials desired within the structure. By adding a pair of plate lenses (not shown) at the ends of the quadrupole structure 400 to provide the axial DC trapping field, an ion trap is formed. An interior trapping volume 425 is defined by two end plates (not shown), at least one of which has an aperture, with the appropriate voltages to keep the ions trapped in the interior trapping volume 425, a volume, for example, on the order of 40 mm in length. The entrance end plate can be used to gate ions in the direction of the arrow 430 into the ion trap. The two end plates differ in potential from the trapping volume such that an axial "potential well" is formed in the trapping volume to trap the ions. For example, as discussed earlier, a 200 V axial trapping potential is enough to confine the ions to the trapping volume, the central 40 mm of the ion trap. However, in this configuration the ions experience more axial field inhomogenities than typically experienced by the ions in a three-sectioned ion trap (as described above) due to the fringe fields produced at the end of the rods and also to the truncation of any aperture in the rods. Elongated apertures 435 in the electrode structures 415, 420 allow the trapped ions to be mass-selectively ejected (in the mass selective instability scan mode) in the direction of the arrows 440, a direction orthogonal to the central axis 445 of the quadrupole structure 400. The central axis 445 extends longitudinally parallel to the rods. This enables the quadrupole structure 400 to be utilized as an ion trap mass spectrometer, provided that the ejected ions are passed onto a suitable detector to provide the mass-to-charge ratio information.

In this particular aspect of the invention, the two-dimensional substantially quadrupole potentials are generated by hyperbolic shaped rods. However, the rods 405, 410, 415, 420 may be generated by straight or other curved rod shapes. Similarly, the geometry of the aperture 435 is dependent in part on the shape and curvature of the elongated rod structure.

During ion injection, ions are axially injected into the linear quadrupole structure 400. The ions are radially contained by the RF quadrupole trapping potentials applied to the X and Y rod sets 405, 410 and 415, 420 respectively. The ions are then axially trapped by applying trapping potentials to the end plate lenses. After a brief storage period, the trapping parameters are changed so that trapped ions become unstable in order of their mass-to-charge ratio. This may entail changing the amplitude of the RF voltage so that it is ramped linearly to higher amplitudes, while a dipolar AC resonance ejection voltage is applied across the rods in the direction of the detection. These unstable ions develop trajectories that exceed the boundaries of the ion trap structure and leave the field through an aperture 435 or series of apertures in the rod structures 415, 420. The ions are collected in a detector and subsequently indicate to the user the mass spectrum of the ions that were trapped initially. Damping gas such as Helium (He) or Hydrogen ($H_2$), at pressures near $1\times10^{-3}$ Torr is utilized to help reduce the kinetic energy of the injected ions and therefore increase the trapping and storage efficiencies of the linear ion trap. This collisional cooling continues after the ions are injected and helps to reduce the ion cloud size and energy spread which enhances the resolution and sensitivity during the detection cycle.

The linear ion trap described above can also be used to process and store ions for later axial ejection into an associated tandem mass analyzer such as a Fourier transform mass analyzer, RF quadrupole analyzer, time of flight analyzer, three-dimensional ion trap analyzer or an electrostatic analyzer.

An important feature of the linear ion trap is the elongated aperture 435 which allows ions to exit the quadrupole structure 400 in order to be detected. In a first aspect of this invention, the aperture (or apertures) 435 is cut radially through one or more of the rods of the linear ion trap. In general, the presence of an aperture 435 introduces field faults distorting the radial quadrupolar potential and the axial field homogeneity, which, if not considered, can degrade the performance of the mass spectrometer yielding poor resolution and mass accuracy. This distortion can be minimized by using as small an aperture 435 as possible, which is of small length and small width. However, the length and the width of the aperture 435 directly determine how much of the ion cloud will actually be ejected from the trap and reach the detector, and therefore these dimensions are critical in determining sensitivity. For optimum ejection efficiency, the aperture needs to be at least as long as the axial extent of the ion cloud. In the case where the axial length of the aperture and the ion cloud are the same, ions located near the ends of the aperture experience contributions to the electric field from sections of the rod which do and do not include the aperture. As a result, a change in the radial field strength occurs in this region. As discussed above, this would cause ions of the same mass to be ejected at slightly different times than ions closer to the center of the trapping volume, causing the resolution of the resulting mass spectrum to be degraded.

FIG. 4C illustrates a cross-sectional view of the Y rods 415, 420 according to an aspect of the invention, in which the aperture 435 is optimized to avoid possible fringe effects whilst preserving the structural integrity of the quadrupole rods 415, 420. In this example, the linear quadrupole structure 400 has hyperbolic rod profiles with an $r_0$ of 4 mm. The hyperbolic rods, in operation, provide for a trapping volume 425 having a central axis 445. Containment of the ions radially in the linear two-dimensional trap is achieved by providing a substantially quadrupolar potential in the trapping volume 425. The end plates (not shown), each with a discrete DC level, allow containment of the ions in the axial region of the ion trap 400.

The aperture 435, as shown, is an elongated slot that extends radially through the rods 415 and 420. The opening of the aperture 435 that is on the face of the rod that faces away from the trapping volume 425, has two ends 450, 455. The aperture 435 is configured such that ions can pass from the interior trapping volume 425 through the aperture 435 to a region exterior to the interior trapping volume 425, which is outside the confinement of the four rods 405, 410, 415, and 420. A recess 460 is disposed adjacent the aperture 435, extending longitudinally along the rods 415 and opens to the interior trapping volume 425. This recess 460, unlike the aperture 435, does not extend radially through the rod 415. The base 465 of the recess 460 has a length 470 (6 mm) that extends longitudinally away from the aperture 435, and a depth 475 that does not fully penetrate through the thickness of the rod 415. The depth 475 of the recess 460 is greater than the width of the recess 480, for example, two or three times greater, for reasons that shall be explained later. Ideally, the length 470 of the recess 460 could extend to the end of the rod 415, 420, but any extension beyond the length 485 of the aperture 435 is beneficial. In this particular case, two recesses 460 are illustrated, one recess at each end 450, 455 of the elongated slot 435. Also, the recesses 460 as shown are coupled directly to the aperture 435, creating one large volume.

As illustrated, the elongated slot is configured with substantially parallel walls, and therefore the length of the aperture 435 at the surface of the rod that faces exterior to the interior trapping volume 425, is that same as that of the inner length 485, that is inner length 485 of the aperture 435 at the base 465 of the recess 460. The width 480 of the recess 460 has substantially the same width 495 as the aperture 435.

In this aspect of the invention an aperture design for a linear ion trap is provided, in which the aperture is optimized to minimize possible fringe effects whilst preserving the structural integrity of the quadrupole rods. From the view of the ions themselves, in the trapping volume 425, the opening into the aperture 435 appears to be a combined length 490, in this particular case 41 mm, which allows the ions to experience less axial field inhomogeneities than a 29 mm slot, for example. The combination of the two recesses 460 which do not fully penetrate the rods 415 of 420 and the aperture 435, which does fully penetrate the rods 415 of 420 appear to the ions to be an aperture of combined length 490. The fact that the depth 475 of the recess 460 is greater than, typically several times deeper than the width 480 creates fields which are equivalent to a slot, or an aperture that fully penetrates the rods 415, 420. If the 41 mm length were to actually fully penetrate the rods 415, 420, the excessive removal of material required to form such a 41 mm long elongated slot would weaken the overall structure integrity of the rods 415, 420 and they would be more prone to flexing along their length during the formation of the quadrupole rods themselves. Both the inner length 485 of the aperture 435 at the base 465 of the recess 460, and the length of the aperture 435 on the face of the rod that faces away from the interior trapping volume 425, in this example are both 29 mm, which is a smaller length than the combined length 490 (a 41 mm opening), the combination of the length of the two recesses 460 and the aperture length 485, providing for a mechanically sound structure, but providing the functionality required.

Figure 5:
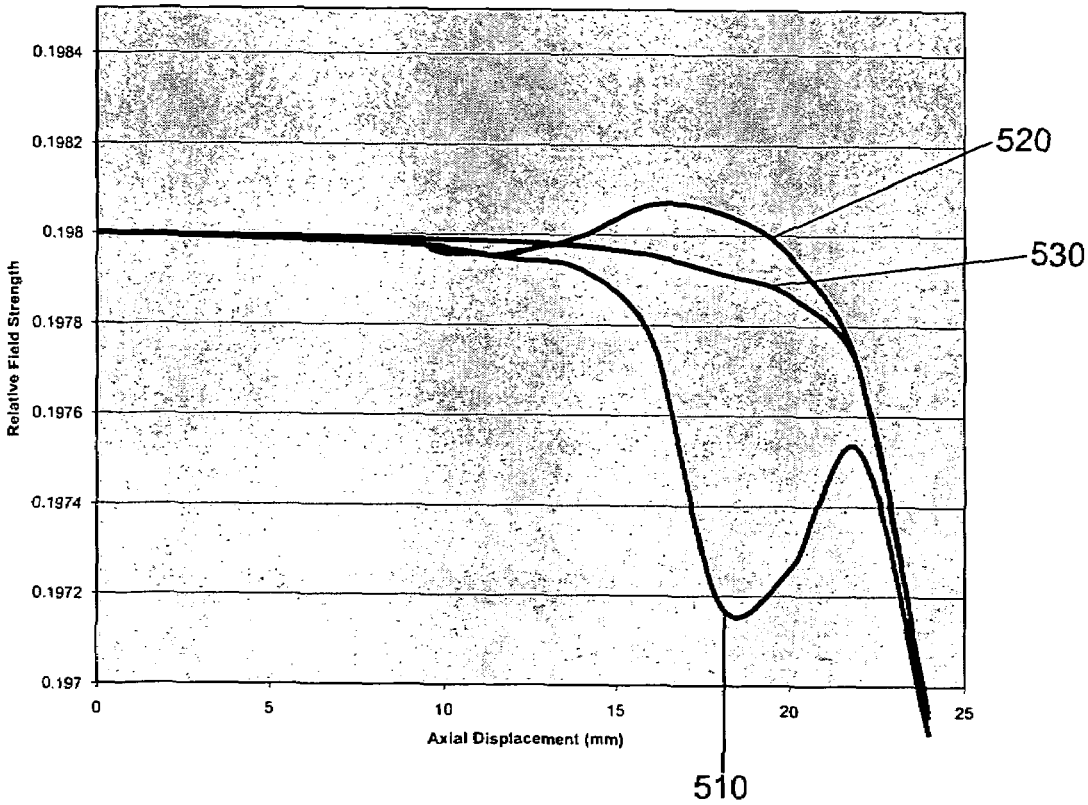
FIG. 5 is a graph showing the axial homogeneity of the radial field for various ion trap configurations.

FIG. 5 shows the axial homogeneity of the radial field in various linear ion trap designs. Trace 510 shows the field for a three-segmented quadrupole rod structure, as illustrated in FIG. 1, the aperture having no recess as described herein, and being in the region of 29 mm in length. A strong drop in field can be seen at approximately 18 mm due to the gap between the rod segments. Fortunately, ions travel only about 12 mm from the axial center, and thus do not experience this inhomogeneity.

Figure 3:
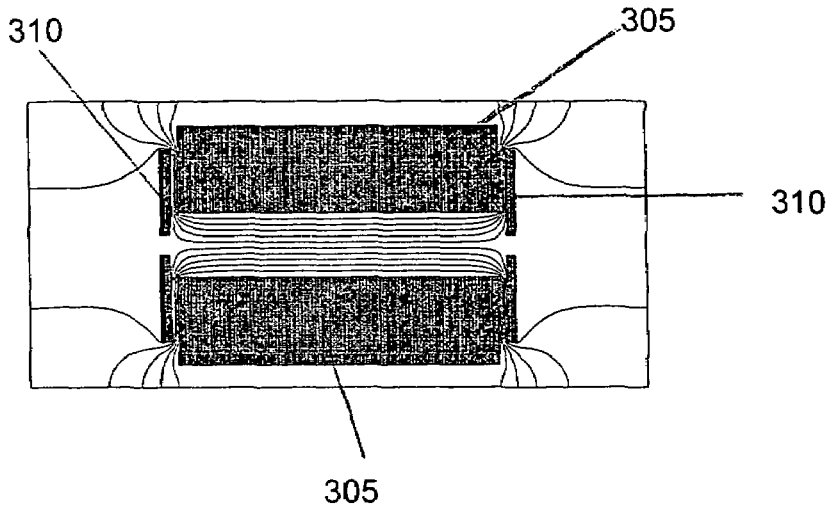
FIG. 3 is a schematic illustration of a single section linear ion trap with end plates for axial trapping, which also illustrates the resonance excitation fields.

Trace 520 illustrates the axial inhomogeneity for a linear ion trap as illustrated in FIG. 3 (no axial segments) with a 29 mm aperture. The field initially weakens at approximately 12 mm displacement, and then strengthens at approximately 17 mm. The absence of axial segmentation of the rods allows displacements up to approximately 20 mm from the trap center, and thus ions will experience these field inhomogeneities. This ultimately could result in an ion trap with poor resolution.

Trace 530 illustrates the axial inhomogeneity for a linear ion trap as illustrated in FIG. 4A, with a 41 mm combined length (aperture and recess length) on the inner surface (facing the interior trapping volume 425) of the rods 415, 420, and a 29 mm aperture length on the outer surface (away from the interior trapping volume 425) of the rods 415, 420. In this particular case, the homogeneity is much improved, with the axial field falling off at large axial displacements due to fringe fields from the end lenses. Across the central region of approximately 40 mm, the region which ions are expected to occupy, the field homogeneity is similar to that observed for the linear trap illustrated in FIG. 1 (trace 510), and this leads to an ion trap with mass resolution similar to that of a ion trap with segmented rods.

FIGS. 6A to 6D show an alternative substantially quadrupolar structure 600 comprising two pairs of opposing electrodes. Although all four rods have a hyperbolic profile, as can be seen, one pair of electrodes, the X rods 605, 610 includes the use of insulating material 695 in addition to the conventional rod material. In this example, the aperture 635 is tapered, it opens in an outwardly direction from the interior trapping volume to a region exterior to the interior trapping volume 625. As mentioned earlier, the three significant dimensions in the eyes of the ions are the inner length 685 of the aperture 635 at the base 665 of the recess 660, the combined aperture 635 and recess length 670 on the inner surface (facing the interior trapping volume 625) of the rods 415, 420, and the depth 675 of the recess 660. That being the case, as illustrated in FIG. 4C, the aperture length on the side of the rods facing away from the interior trapping volume 625 can be larger than the inner length 685 of the aperture 635. In this particular example, the aperture 635 opens outwardly in a direction from the interior trapping volume 625 to a region exterior to the interior trapping volume 625. This is created by utilizing slanted or chamfered walls to create the aperture 635 (as can be seen in FIG. 6A).

The aperture 635 is not the only feature that may be tapered as described above. The recess 660 may also open outwardly in a direction from within the rod toward the interior trapping volume 625. In alternative implementations, the aperture 635 can comprise a counterbore configuration that is widened to a region exterior to the trapping volume 625 in one or more discrete steps.

The number of apertures utilized in the linear ion trap can be varied for several reasons. First to help determine or define the kind of field faults created by the apertures themselves. For example, as mentioned above, if only one aperture in one rod is used, large amounts of odd-ordered potentials such as dipole and hexapole potentials are generated. Whereas, if two apertures of identical size are used on opposing rods, even order potentials such as the quadrupole and octopole potentials are effected. These different kinds are potentials are known to cause increased or decreased performance in terms of mass accuracy and resolution. Consequently, the magnitude of each of these different potential types can be tailored using the number and dimensions of the apertures in this device.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated.

What is claimed is:

1. A linear ion trap for trapping and subsequently ejecting ions comprising:

a plurality of rods defining an interior trapping volume having an axis extending longitudinally, one or more rods including an aperture extending radially through the rod, the aperture being configured such that the ions can pass from the interior trapping volume through the aperture to a region outside the interior trapping volume; and at least one recess formed in the one or more rods and disposed adjacent the aperture, extending longitudinally along the rod, opening to the interior trapping volume, the recess not extending radially through the rod.

2. The linear ion trap according to claim 1, wherein:

the plurality of rods are multipole rods shaped to provide a substantially quadrupolar potential in the interior trapping volume.

3. The linear ion trap according to claim 1, wherein:

the recess is directly coupled to the aperture.

4. The linear ion trap according to claim 1, wherein:

the at least one recess is at least two recesses.

5. The linear ion trap according to claim 1, wherein:

the recess has a depth extending radially into the rod, the depth being greater than a width of the recess.

6. The linear ion trap according to claim 5, wherein:

the depth of the recess is at least three times greater than the width of the recess.

7. The linear ion trap according to claim 1, wherein:

the aperture opens outwardly in a direction from the interior trapping volume to a region exterior to the interior trapping volume.

8. The linear ion trap according to claim 1, wherein:

the recess opens outwardly in a direction from within the rod towards the interior trapping volume.

9. The linear ion trap according to claim 1, wherein:

the aperture is an elongated slot having two ends.

10. The linear ion trap according to claim 9, wherein:

the recess extends longitudinally beyond one end of the slot.

11. The linear ion trap according to claim 9, wherein:

the recess is disposed at one of the two ends of the slot.

12. The linear ion trap according to claim 9, wherein:

the at least one recess comprises two recesses, one recess disposed at each end of the elongated slot.

13. The linear ion trap according to claim 9, wherein:

the elongated slot has a width, and the width of the recess is substantially the same as the width of the elongated slot.

* * * * *